United States Patent [19]

De Schamphelaere et al.

[11] Patent Number: 4,589,762

[45] Date of Patent: May 20, 1986

[54] TONER DISPENSING CONTROL

[75] Inventors: Lucien A. De Schamphelaere, Edegem; Freddy M. Librecht, Boechout; Willy G. Verlinden, Edegem, all of Belgium

[73] Assignee: Agfa-Gevaert N.V., Mortsel, Belgium

[21] Appl. No.: 613,736

[22] Filed: May 24, 1984

[30] Foreign Application Priority Data

Jun. 3, 1983 [EP] European Pat. Off. ..... 83200801.5

[51] Int. Cl.[4] ..... G03G 15/08

[52] U.S. Cl. ..... 355/14 D; 118/689

[58] Field of Search ..... 355/3 R, 3 DD, 14 D; 118/656, 688, 689, 690

[56] References Cited

U.S. PATENT DOCUMENTS

| | | | |
|---|---|---|---|
| 3,409,901 | 11/1968 | Dost et al. | 355/14 D X |
| 3,529,546 | 9/1970 | Kollar | 355/14 D X |
| 4,032,227 | 6/1977 | Hubbard et al. | 355/14 D |
| 4,190,018 | 2/1980 | Ariotti et al. | 118/690 |
| 4,210,864 | 7/1980 | Miyakawa et al. | 355/3 DD X |
| 4,260,073 | 4/1981 | Baumann | 355/3 DD X |
| 4,342,283 | 8/1982 | Terashima | 355/3 DD X |
| 4,413,264 | 11/1983 | Cruz-Uribe et al. | 355/14 D X |
| 4,468,112 | 8/1984 | Suzuki et al. | 355/14 D |

FOREIGN PATENT DOCUMENTS 57-146263 9/1982 Japan .

*Primary Examiner*—Fred L. Braun

*Attorney, Agent, or Firm*—William J. Daniel

[57] ABSTRACT

Toner dispensing control in xerographic printing, wherein a toner dispenser is controlled during the initial period of use of a new toner mixture by a first control unit that is at least predominately responsive to the number of discrete exposures of the photoconductor, and during a further period of use a second control unit that is at least predominately responsive to the relative electrical permeability of the toner mixture. Over-toning during the running-in of a new toner mixture is thereby avoided.

9 Claims, 3 Drawing Figures

TONER DISPENSING CONTROL

The present invention relates to a method and a device for toner dispensing control in a xerographic printer.

In xerographic printers wherein a photoconductor is electrostatically charged, image-wise exposed, and finally developed by contact with toner particles attracted thereto from mixture of magnetically susceptible carrier particles and toner powder provided in a developing station, there is provided a toner dispenser for adding toner powder to the mixture as the toner powder is consumed on development of the electrostatic charge pattern in order to keep the concentration of the mixture constant.

It is known to control the concentration of the toner mixture by inductively measuring the carrier concentration i.e. the amount of carrier per unit of volume, comparing the measured concentration value with a set or reference value, and using the deviation between these values as a signal to control the toner dispenser to add toner powder. This control, which is a feedback control, is based on the ferro-magnetic character of the carrier particles, and on variations in the inductance of a coil as a consequence of variations in the concentration of carrier particles within the electro-magnetic field of the coil. Variations in the concentration of carrier particles result in corresponding variations of the relative electrical permeability of the toner mixture. This method of control (also known as ATCR: automatic toner control regeneration) is known for instance from co-pending European application No. 83 200 134.1, relating to an apparatus employing a device incorporating induction coils for monitoring the concentration of toner in a toner/carrier mixture, and copying apparatus incorporating same.

This method of control does not operate satisfactorily in practice, since it has been shown that there occurs a notable deviation of the correct response of the control, in particular during the running-in period of a new toner mixture, which period may cover the production of some thousands of prints.

During the running-in period of a new developer the carrier packing density changes due to the smearing of toner particles or toner additives on the carrier particles. This smearing effect decreases the friction coefficient of the surface of the carrier particles and increases the degree of carrier packing.

In consequence the measurement will measure an increased amount of carrier particles per unit of volume, and derive therefrom the erroneous conclusion that this increase has been caused by a reduction of toner powder so that the dispenser will be controlled to add more toner powder whereby overtonering occurs. This causes an increase of the fog level on the print, a too high density of the image, and thick and smeary lines.

It is possible to overcome this difficulty by an "artificial ageing" of a new toner mixture by the manufacturer of the toner mixture. Such procedure cannot perfectly simulate the ageing of the toner mixture in normal use, and is economically not attractive since it increases the costprice of the product and at the same time reduces its useful life, i.e. the number of copies that can be produced with a given amount of carrier particles.

It is also possible to provide the control device with supplementary control means, for instance an optical density measurement of the produced print image (occasionally a test zone or a test pattern thereon), and using a feedback loop from such density measurement to control toner dispensing. However such an arrangement is expensive.

Finally it is known to control toner dispensing in an electrophotographic apparatus by integrating signals that are produced by a character generator to produce charge images, and by actuating a toner dispenser when a set value has been achieved. Suchlike system is disclosed in DE-B-1772826. It has the disadvantage that in the long run no accurate control of the developer composition is obtained.

It is the object of the present invention to provide an improved method and device for toner dispensing control in a xerographic printer, more in particular in a printer of the type wherein the image-wise exposure of the photoconductor occurs by line-wise exposing the photoconductor by appropriate activation of a plurality of linearly-spaced discrete sources of radiation.

According to the present invention, a method for controlling the dispensing of toner powder in xerographic printing of the type wherein a photoconductor is electrostatically charged and image-wise exposed by line-wise exposing the photoconductor by activation of discrete spotlike sources of radiation spaced along such line in response to corresponding data bits, and the electrostatic image thus produced is developed by contact with a toner mixture comprising magnetically susceptible carrier particles and toner powder which is attracted thereto at a developing station provided with a toner dispenser for dispensing toner to the toner-depleted mixture, and wherein operation of the toner dispenser is directly controllable in response to a main control signal produced when the relative electrical permeability of the toner mixture deviates from a set or reference value by a predetermined amount, is characterised in that the operation of the toner dispenser is directly controllable also by a further control signal obtained by counting the number of operative radiation sources during exposure of the photoconductor and producing the further control signal each time a preset number of operative radiation sources is attained; and wherein the relative degree of control of the main and further control signals to control the operation of toner dispensing is altered after a predetermined period of use of a new toner mixture.

The expression "discrete sources of radiation", spaced along an exposure line, denotes in the present specification one or more linear arrays of LED's (light emitting diodes) or like stationary energy radiators, that may be energized to produce the desired exposure of the photoconductor. The expression includes also a scanner, e.g. a laser scanner, the beam of which is modulated during the scanning to determine during each scan movement a plurality of elementary image sites that may receive radiation or not depending on the modulation of the radiation beam.

The sources of radiation may be sequentially operative, as in a linear printer, but they may also be group-wise operative, as in a linear array of LED's where the recording signal is fed to the LED's through a serial in-parallel out register, and a latch register, so that all the LED's that are required for the writing of one image line, may yet be energized all together during the same period of time.

The developed toner image of the photoconductor may be transferred to another support, e.g. a plain paper sheet, whereon it may be fixed to constitute the final image, but the invention does not exclude a photoconductor where the toner image is fused on the photoconductor itself to thereby form the final image. Further, a support with a fixed toner image may also be used after suitable treament to constitute a planographic printing plate.

The counting of the number of operative sources of radiation may simply be performed by connecting the electric data bit control signal(s) for such sources to a counter that is arranged to count each time one bit as a source is controlled to emit radiation to an elementary image site on the photoconductor. The pre-set number of operative sources in practice may not be attained until several exposures of the photoconductor have been made, but such number may possibly also be attained during the first exposure of the photoconductor, for instance in the case of an image containing an important amount of "black", this in contrast with a conventional printed text the total surface of which comprises usually only between 5 and 10% black area.

The processing of the two control signals to alter or adjacent their degree of control during the life of the toner mixture may suitably occur as a function of a readily determined initial period of use of a new toner mixture (the "running-in" period). Since the measure of use or life of the toner mixture depends on the time of operation of the developer station, and not on the rate at which the toner powder is being consumed, the running-in period may suitably be determined by an aggregate number of exposures, i.e. prints or copies made.

In a preferred embodiment of the invention, the toner dispensing during the "running-in" period is controlled solely as a function of the control signal from the bit counting, and during the remaining period solely as a function of the control signal from the relative electrical permeability measurement of the developer mixture. However, it should be understood that the toner dispensing may alternatively be first controlled predominantly by the control signal from the bit counter and then be controlled predominantly by the control signal from the magnetic density measuring circuit for determining the relative permeability.

The invention includes also a new device for the control of toner dispensing.

According to this aspect of the invention, a toner dispensing control device in a xerographic printer of the type wherein a photoconductor is electrostatically charged and image-wise exposed by line-wise exposing the photoconductor by means of activation of a plurality of linearly-displaced discrete sources of radiation in response to corresponding data bits, and developed by contact with toner particles attracted thereto from a mixture of magnetically-susceptible carrier particles and toner powder in a developing station provided with a toner dispenser, and a measuring circuit for measuring the relative electrical permeability of carrier particles per unit of volume and comparing the measured permeability with a set or reference value and producing upon deviation of the actual from the set permeability a main control signal, and means for applying the main control signal directly to a controller as an input for operating the toner dispenser, is characterised in that the device comprises a pre-settable data bit counter for counting an aggregate number of operative radiation sources during exposure of the photoconductor and for producing, each time a pre-set aggregate number is attained, a further control signal for the toner dispenser and means for applying the further control signal directly as an input to the controller for operating the toner dispenser, and means for altering or adjusting the relative degree of control of the main and further control signals to control the operation of the toner dispensing during the period of use of the toner mixture.

The means for altering or adjusting the relative degree of control may comprise means for selecting a given running-in period for a new toner mixture, and means for operating said controller in response to achievement of that given period of the toner mixture so that, prior to the reaching of the pre-set period, the controller is responsive at least predominantly to the control signal from the data bit counter and, as the running-in period has been finished, the controller is responsive during the further lifetime at least predominantly by the control signal from the measuring circuit of the relative permeability.

Further the means for operating the controller in response to the pre-set running-in period of the toner mixture is preferably so arranged that prior to the end of the pre-set period, the controller is responsive only to the control signal from the data bit counter and, as the pre-set period has been attained, the controller is then responsive during the further lifetime only to the control signal from the measuring circuit of the relative permeability.

The invention will be described hereinafter by way of example with reference to the accompanying drawings wherein.

Figure 1:
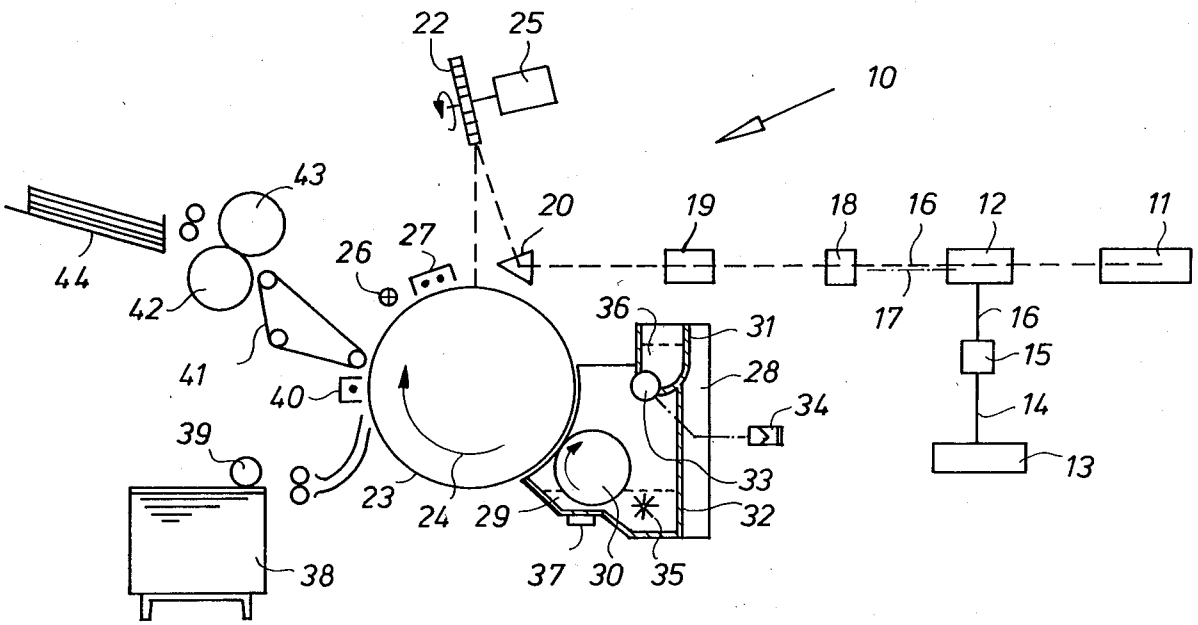
FIG. 1 is a diagrammatic illustration of one embodiment of a laser printer.

FIG. 1 shows a laser printer designated generally 10. A laser light source 11 transmits a collimated light beam to light beam modulator 12. Signals which designate data bits, "ones" or "zeros", from character generator 13 and which represent portions of alphanumeric characters to be printed by the laser printer 10 are sequentially transmitted over line 14 to RF (radio frequency) generator 15. If one bit signal is transmitted, RF generator 15 transmits a RF voltage over line 16 to light modulator 12, otherwise no RF voltage is transmitted. The individual bit signals are gated or clocked from character generator 13 by a character generator clocking signal.

The light beam modulator 12 may be an acousto-optical modulator which, in response to RF voltages, establishes acoustic vibrations which cause a portion of the input radiation beam to be diffracted through a specific angle along a deflected path. The portion of the deflected beam is called the first order beam 16 while the undeflected beam is called the zero-order beam 17.

The modulated beam is then passed through a negative lens 18 and an adjustable positive lens 19 which together co-operate to control the size and focus of the first order beam. From there, the modulated beam impinges on prism 20, and then upon a multifaceted rotating reflection mirror 22 driven by a motor 25.

Rotating mirror 22 acts on the modulated beam reflecting it toward the photoconducting drum 23 while at the same time causing it to sweep repeatedly in fan-like fashion in a plane tangential to the drum. In a preferred embodiment, only the first order beam 16 is enabled to impinge upon the surface of the photoconducting drum 23. Hence, when logic one signals stored in the character generator memory are transmitted as high bit signals to RF generator 15 which causes RF pulses to be transmitted to light beam modulator 12 which in turn causes first order beam 16 to be switched on, then light impinges on photoconducting drum 23 to image a dot thereon.

Photoconducting drum 23 is caused to rotate in the direction of the arrow 24 while the periodically sweeping laser beam traverses a series of parallel straight lines across the surface of the drum. The straight lines are parallel to the axis of the drum.

Rotating drum 22 is a highly polished multi-faceted mirror rotating several hundreds of revolutions per minute, so that adjacent straight lines traversed on the photoconducting drum 23 may be designed to be approximately 0.0625 mm apart. Since the first order light beam is caused to switch on and off at a RF frequency in the order of magnitude of tens of Megacycles, each straight line path is provided with a large number of possible dot sites, for instance 3456 in a 21 cm straight line segment.

When a first order beam strikes the drum the electrostatically charged drum is locally discharged at the exposure site, so that development of the charge image by a toner charged to the same polarity as the initial charging of the drum which would be repelled otherwise by such like polarity, may cause a dark dot to be recorded on the final output of the printer.

When the beam is not present, a white or undeveloped space is left on the print. In this way, alphanumeric characters are printed as a series of dots and no dots in accordance with data bits produced in the character generator.

The processing of the photoconducting drum is as follows. Prior to the dot-wise exposure, drum 23 is uniformly flooded with light from a source 26 in order to completely discharge the photoconductor after the previous exposure. The photoconducting drum 23 is then uniformly electrostatically charged by corona discharge from a charging station 27.

The dot-wise discharged charge pattern remaining after exposure by the laser beam, is developed in a developing station 28 containing a two-component developing mixture 29 which is composed of triboelectrically chargeable toner powder and magnetisable carrier particles, and which is fed to the developing site by a so-called magnetic brush 30 which is a roller with magnets provided in its interior space, whereby a layer of developer mixture is pulled upwardly by the roller as the roller rotates in the illustrated direction. The developing station comprises also a toner dispenser with a toner tank or hopper 31 provided above the developer tank 32 for storing toner powder 36 therein, and has at its lower portion an opening for supplying the toner therethrough, and a toner supplying roller 33 with a mantle of open-cell polymer foam that closely fits to the opening. Stepwise rotation of roller 33 under control of a solenoid 34 that actuates a pawl that engages a toothed pawl wheel fitted on the shaft of the roller (not illustrated), causes the roller to remove at each angular step a controlled amount of powder from the hopper 31, which powder falls by gravity in the developer mixture 29 in the tank 32, and is mixed therewith through the stirring wheel 35. Finally there is provided a measuring coil 37 at the bottom of the developer tank for sensing the relative permeability of the developer mixture.

The developed toner image on the drum 23 is transferred to a plain paper sheet fed from a stack 38 of such sheets. A dispenser roller 39 removes each time the upper sheet from the stack, and feeds it in timed sequence towards the drum 23 so that the leading sheet edge coincides with the leading edge of the toner image on the drum. A transfer corona 40 causes the transfer of the toner image of the drum towards the paper sheet. The sheet is then transported by a belt conveyor 41 towards a fixing station where the toner image is fused into the sheet under the application of heat and pressure by rollers 42 and 43. The prints are finally received in a tray 44.

Figure 2:
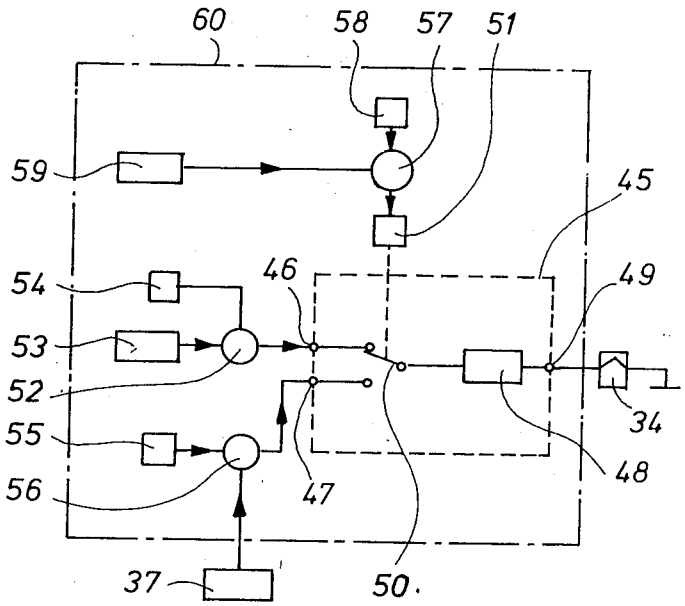
FIG. 2 is a diagrammatic illustration of a toner dispensing control circuit for the printer of FIG. 1.

One embodiment of a toner dispensing control of the printer is illustrated diagrammatically in FIG. 2. The control circuit comprises a signal processor 45 which has two inputs 46 and 47 that can control a controller 48 the output 49 of which is connected to the electromagnet 34 that actuates the toner dispensing roller 33. Selection between one of the two inputs 46, 47 occurs under the influence of a switch 50 controlled by a control circuit 51. It will be understood that switch 50 is not a moveable mechanical member, but an electronic semiconductor circuit.

The first input 46 receives a signal from the control circuit 52 which produces a logic one signal each time the data bit counter 53 has counted a number of bits that corresponds with a given aggregate number that has been set in the pre-set data bit number circuit 54.

The setting of the circuit 54 is such that, taking account of all the characteristics of the apparatus, as there are the photoconductor response, the initial charging at station 24, the electric potential of the magnetic brush 30, the tribo-electric characteristics of the developer mixture, etc., one dispensing operation of the toner dispensing roller 33 is of a nature to add precisely that amount of toner powder to the mixture, that has been removed by the development of the pre-set number of data bits on the image. It will be clear that the determination of this response is rather a matter of careful examination of the behaviour of the apparatus in practice, rather than of selecting a purely theoretical setting. Practice shows that all the concerned parameters remain substantially constant in a good functioning apparatus.

It will be understood that the predictability of toner consumption in operation of the apparatus, which form the basis of the control described so far, cannot possibly be absolutely correct so that after the apparatus has been in operation for a certain time, a toner concentration deviation from its proper value will occur that is no longer acceptable.

Therefore, the toner dispensing control is taken over after a given period of operative life of the toner mixture, by a further control based on measurement of the relative electrical permeability which is considered to be representative for the actual toner concentration of the mixture after the toner mixture has been run-in.

Thus further control comprises the measurement circuit 37 (which may be based on the varying self-induction of a coil as hereinbefore described), a circuit 55 for setting the desired relative permeability of the toner mixture, and a comparator 56 for comparing the signals of both circuits and for producing upon a certain deviation therebetween a control signal for the controller 48. The relative permeability control is made operative by the switching of switch 50 to connect the controller 48 to input 47. Switching of 50 is controlled by control circuit 57 that produces a signal for the switch circuit 51, after a pre-set number of prints, set in circuit 58, has been counted by the print counter 59. The number of prints set in counter 58 may vary from a few hundreds to a few thousands, depending on the period of time that is required for the running-in of the toner mixture. Said running-in is a mechanical phenomenon which is virtually independent from the amount of toner powder consumption, and thus the counting of the number of produced prints forms a simple measure to determine a given period of use of the toner mixture. As will have become apparent from the disclosure of the specification so far, the term "running-in" is used herein to denote the elapsed period of first use of a new toner mixture after which the measuring of the relative permeability of the carrier particles provides a reliable indication for the toner powder concentration of the toner mixture. Other characteristics of the toner mixture may continue to alter after the first period of use, provided their impact on the wanted relationship is negligable.

The pre-setting circuits such as blocks 54, 55 and 58 may be provided as distinct units and arranged for easy setting by the operator of the printer. However they may also be incorporated in the electronic circuitry of the printer and be programmed for performing the desired functions. In a preferred arrangement of the control circuitry of the printer, the functions of all the blocks situated within the periphery of the block 60 illustrated in broken lines, are performed by a microprocessor.

The dispensing control of the described printer need not necessary occur according to either one or the other of the two modes. There may be provided an electronic coupling between the two input signals of the controller 48 which is such that during the running-in period of a new toner mixture, the toner dispensing control occurs predominantly by the signal from the data bit counter and to a lesser extent by the signal from the measuring circuit of the relative permeability, and that after the toner mixture has been run-in, the toner dispensing control occurs predominantly by the signal from the measuring circuit of the relative permeability and to a minor extent by the data bit counting signal.

The following example illustrates the improved operation of a printer according to the invention over a prior art printer that was operated exclusively according to the ATCR mode.

Type of printer: a laser type printer with a selenium coated drum for producing prints on standard DIN A4 format plan paper.

Type of toner mixture:
carrier weight: 600 g
toner weight: 28.8±1.8 g
toner concentration: 4.8±0.3% by weight.
Average toner consumption: 0.7 mg/cm$^2$
Setting of bit setter 54: 5.10$^6$ bits
Setting of print counter 58: 1000 prints
Lifetime of carrier: 50,000 prints.

It was shown that a good control of the concentration of the developer mixture was obtained during the running-in as well as during the further lifetime of the mixture. If the same xerographic printer was operated with the toner concentration control adjusted in accordance with the prior art mode, namely measurement of the relative permeability only, then it was found that as a consequence of increasing packing density during the running-in of a new mixture, the system produced an over-tonering up to 1%, which resulted in too high a density of the developed images, and in an increase of the line-width which gave the impression of too heavy a text.

It is clear that the invention is not limited to the described embodiment of a printer.

A laser printer can comprise a galvanometer controlled mirror to sweep the recording beam, rather than a multifaceted mirror wheel as illustrated.

The printer can comprise a multiplicity of stationary radiation sources, rather than a moving radiation beam. An example of the latter type of printer is formed by so-called LED array printers wherein LED chips are arranged in linear fashion to provide one or two rows of LED's that extend transversely of the path of movement of a photoconductor, and that are focussed, occasionally through self-focussing fibers or the like, onto the photoconductor surface. An example of such printer may be found in co-pending application No. EU-A 82 201 324, filed on Oct. 25, 1982.

It will be understood that a printer according to the invention will comprise many other control means, known in the art, that are indispensable for an easy operation of the apparatus. The printer will include for instance means for signaling the near exhaustion of the toner powder so that the toner dispenser may be timely replenished, means for signaling the end of the operative life of the carrier particles, means for signaling an anomaly with paper feeding, etc. The printer may also be arranged for the automatic resetting of the print counter when a used developer mixture is replaced by a fresh one.

The operation of the toner dispensing device need not necessarily occur by the stepwise rotation of a toner dispensing roller under the control of a solenoid, but such roller may also be otherwise driven, e.g. by a small servo-motor with appropriate reduction gear, and control means to set the time of rotation of the roller upon each toner dispensing operation.

Finally, means can be provided in the developing station for the removal of toner dust that does not contribute to the proper development and that is likely to soil the apparatus.

Such like means can comprise a supplementary wall that is mounted closely spaced from the lower wall and the rear wall of the developer tank, and that is at the lateral sides connected with said lower and rear wall thereby to form an elongate evacuation channel.

Figure 3:
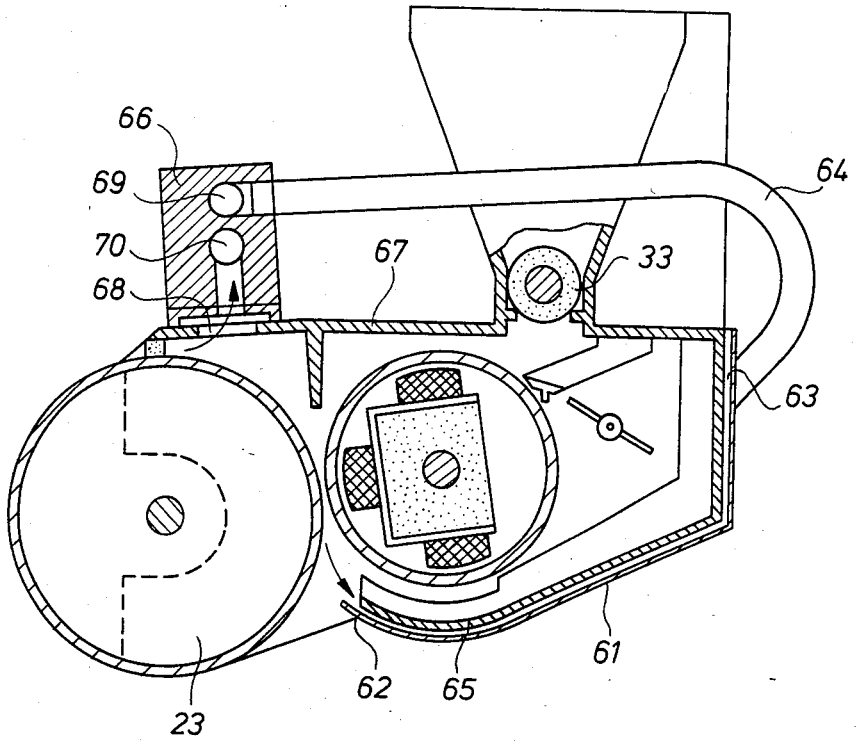
FIG. 3 is a diagrammatic illustration of an arrangement for the removal of toner dust.

Referring to FIG. 3 which is a detailed view of the developing station 32 shown in FIG. 1, a wall 61 runs closely spaced from the bottom and the rear wall of the developer tank 32. The front end of the wall 61 determines together with the corresponding end of the bottom wall 65 of the developer tank a narrow inlet port 62. The wall 61 is near the upper end provided with an opening 63 that is connected via a suction conduit 64 to a distributor block 66.

The upper wall 67 of the developer tank is provided with a slotlike opening 68 that communicates also with the block 66.

Bores 69 and 70 of the block are in communication with a vacuum pump and a dust collector. The two arrows indicate the zones of the developing station where the dust removal is concentrated.

We claim:

1. In a method for controlling the dispensing of toner powder is xerographic copy printing of the type wherein a photoconductor in electrostatically charged and image-wise exposed by line-wise exposing thereof by activation of discrete spotlike sources of radiation spaced along said line in response to corresponding data bit signals of the image to be printed, and the electrostatic image thus produced is developed by contact with a toner mixture comprising magnetically susceptible carrier particles and toner powder which is attracted thereto and the content of said toner powder in said mixture is controllably replenished as said powder is consumed during printing, the improvement comprising the steps of (1) generating a first control signal whenever the electrical permeability of said toner mixture deviates from a reference value by a predetermined amount; (2) generating a second control signal whenever the aggregate number of data bit signals activating any of said radiation sources reaches a predetermined value; (3) controlling the replenishment of the content of said toner powder in said mixture by a combination of the first and second control signals thus generated according to a predetermined ratio; and (4) after an elapsed period of use of a given toner mixture of a predetermined duration, adjusting said predetermined ratio of said combination of first and second control signals to compensate for accumulated errors during said elapsed period in at least said first control signal.

2. A method according to claim 1, wherein said elapsed period of use corresponds substantially to the running-in period of a given toner mixture.

3. A method according to claim 1, wherein during said elapsed predetermined period of use, said toner replenishment is controlled solely by said second control signal, and thereafter during the remaining life of said toner mixture replenishment is controlled solely by said first control signal.

4. A method according to claim 1, wherein during said elapsed period of use, said toner replenishment is controlled by a combined control signal in which said second signal has at least a predominant value in said ratio; and after said elapsed period replenishment is controlled by an adjusted combined control signal in which said first control signal has at least a predominate value in said ratio.

5. A method according to claim 1, wherein the said elapsed period of use is determined as a predetermined number of copies printed.

6. In a xerographic printer of the type wherein a photoconductor is electrostatically charged and imagewise exposed by line-wise exposing the same by means of activation in response to corresponding data bit signals of a plurality of discrete spotlike sources of radiation spaced along said line of exposure, and developed by contact with toner particles attracted thereto from a mixture of magnetically-susceptible carrier particles and toner powder in a developing station, and said developing station including a toner dispenser operative to add fresh toner powder to said mixture to replenish the content of toner powder therein as the same is consumed during printing, in combination, a toner dispensing control system comprising: a measuring circuit for measuring the relative electrical permeability of the toner mixture and for comparing the measured value with a reference value and producing upon deviation of the measured value from the reference value a first control signal, a pre-settable counter for counting the number of data bit signals activating said radiation sources during exposure of the photoconductor and for producing when said counted number reaches a pre-set magnitude a second control signal, a controller for operating said toner dispenser, means for applying said first and second control signals to said controller according to a predetermined ratio to form a combined signal for controlling said dispenser and means for adjusting said ratio after a predetermined elapsed period of use of a given toner mixture to compensate for accumulated errors in at least said first control signal occurring during said elapsed period of use.

7. A toner dispensing control device according to claim 6, wherein the means for adjusting the ratio of said first and second signals in said combined control signal is a switch means operable to connect the said second control signal to the toner dispenser controller during said predetermined period of use of a new toner mixture, and connect said first signal to said controller after said predetermined period of use has elapsed.

8. A toner dispensing control according to claim 6, wherein said means for adjusting the ratio of said separate signals is an electronic coupling adapted to combine said separate signals according to said predetermined ratio.

9. A toner dispensing control device according to claim 6, wherein said adjusting means comprises a copy-counter for producing a control signal when a predetermined number of copies has been attained, corresponding to said elapsed period of use.

* * * * *

UNITED STATES PATENT AND TRADEMARK OFFICE

CERTIFICATE OF CORRECTION

PATENT NO. : 4,589,762

DATED : May 20, 1986

INVENTOR(S) : Lucien A. De Schamphelaere et al

It is certified that error appears in the above-identified patent and that said Letters Patent is hereby corrected as shown below:

In the Claims:

Claim 1, column 8, line 65, "is" should read -- in --;

line 66, "in" should read -- is --.

Signed and Sealed this

*Fifth* Day of *August 1986*

[SEAL]

*Attest:*

DONALD J. QUIGG

*Attesting Officer*

*Commissioner of Patents and Trademarks*